US009989219B2

(12) United States Patent
Hall et al.

(10) Patent No.: US 9,989,219 B2
(45) Date of Patent: Jun. 5, 2018

(54) LIGHT BULB WITH A MOTOR

(71) Applicants: David R. Hall, Provo, UT (US); Hyrum Malone, Provo, UT (US); Justin Robinson, Provo, UT (US)

(72) Inventors: David R. Hall, Provo, UT (US); Hyrum Malone, Provo, UT (US); Justin Robinson, Provo, UT (US)

( * ) Notice: Subject to any disclaimer, the term of this patent is extended or adjusted under 35 U.S.C. 154(b) by 97 days.

(21) Appl. No.: 15/294,097

(22) Filed: Oct. 14, 2016

(65) Prior Publication Data

US 2018/0106461 A1 Apr. 19, 2018

(51) Int. Cl.

| | |
|---|---|
| ***F21V 11/00*** | (2015.01) |
| ***F21V 14/08*** | (2006.01) |
| ***F21V 7/06*** | (2006.01) |
| ***F21V 3/02*** | (2006.01) |
| ***F21K 9/232*** | (2016.01) |
| ***F21K 9/235*** | (2016.01) |
| ***F21S 9/02*** | (2006.01) |
| ***F21V 23/00*** | (2015.01) |
| *F21Y 115/10* | (2016.01) |
| *H05B 37/02* | (2006.01) |

(52) U.S. Cl.

CPC ..... *F21V 14/08* (2013.01); *F21K 9/232* (2016.08); *F21K 9/235* (2016.08); *F21S 9/02* (2013.01); *F21V 3/02* (2013.01); *F21V 7/06* (2013.01); *F21V 23/003* (2013.01); *F21Y 2115/10* (2016.08); *H05B 37/0227* (2013.01); *H05B 37/0272* (2013.01)

(58) Field of Classification Search

CPC ..... F21L 7/00; F21L 4/00; F21L 15/02; F21L 15/06; F21V 14/045; F21V 17/02; F21V 19/02; F21V 14/025; F21S 48/1742; F21S 48/10; F21S 48/1145; B60Q 1/076; B60Q 1/1415

See application file for complete search history.

(56) References Cited

U.S. PATENT DOCUMENTS

| | | | | |
|---|---|---|---|---|
| 9,611,992 | B2 * | 4/2017 | Scales | F21S 8/043 |
| 2009/0201682 | A1 * | 8/2009 | Dyson | F21S 10/00 362/282 |
| 2010/0068899 | A1 * | 3/2010 | Shvili | F21V 19/006 439/39 |

* cited by examiner

*Primary Examiner* — Minh D A

(57) ABSTRACT

A light bulb is disclosed herein, which in general, includes a light transmitting bulb portion and a base portion. The light transmitting bulb portion includes a rotating light aperture. The base portion includes a motor for rotating the light aperture. The light transmitting bulb portion is rotated independently of the base portion to direct light produced by the light bulb in a direction defined by a rotational position of the light aperture. A controller, battery, and wireless transceiver are included in the light bulb.

20 Claims, 11 Drawing Sheets

LIGHT BULB WITH A MOTOR

FIELD OF THE INVENTION

The present invention relates to light bulbs which rotate to direct light.

SUMMARY

This invention has been developed in response to the present state of the art and, in particular, in response to the problems and needs in the art that have not yet been fully solved by currently available systems and methods. Accordingly, a light bulb which rotates to direct light has been developed. Features and advantages of different embodiments of the invention will become more fully apparent from the following description and appended claims, or may be learned by practice of the invention as set forth hereinafter.

A light bulb is disclosed herein, which in general, includes a light transmitting bulb portion and a base portion. The light transmitting bulb portion includes an aperture. The base portion includes a motor with a hollow shaft. The light transmitting portion is rotated independently of the based portion by the motor to direct light produced by the light bulb in a direction defined by a rotational position of the aperture of the light transmitting bulb portion.

The base portion may include an Edison screw. The light transmitting bulb portion may rotate synchronously with the base portion in a clockwise or counter clockwise direction when the light transmitting bulb portion is pushed in toward the base portion. The light transmitting bulb portion may include one or more sensors. The light transmitting bulb portion may further include a light reflecting portion on an inner surface of the light transmitting bulb portion. The light reflecting portion may be substantially parabolic in shape. The substantially parabolic shape may form a parabolic reflector which may be included in more than 40% of an inner surface of the light transmitting bulb portion.

The light bulb may include one or more light sources. The wiring of the one or more light sources may travel through the hollow shaft of the motor. The light transmitting bulb portion may be pushed in toward the base portion to engage a first gear and a second gear. The first gear and the second gear may interlock to screw the base portion into a light socket. Also, the first gear and the second gear may interlock to unscrew the base portion out of a light socket.

The one or more light sources may be LED (light emitting diode) light sources. Light transmitted from the one or more LED light sources may be transmitted through the light transmitting bulb portion of the light bulb when the light bulb is "on". The light transmitting bulb portion may be rotatable while the light bulb is turned "on" without rotating the one or more LED light sources. The LED light sources may transmit light through the aperture in the light transmitting bulb portion. The one or more light sources may be induction light sources. The light bulb may further include a controller and a power supply operably connected to the one or more light sources. Additionally, the controller may include a processor, memory, and one or more transceivers. The light bulb may further include a spring. The spring may push the light transmitting bulb portion away from the base portion.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

In some instances, features represented by numerical values, such as dimensions, mass, quantities, and other properties that can be represented numerically, are stated as approximations. Unless otherwise stated, an approximate value means "correct to within 50% of the stated value." Thus, a length of approximately 1 inch should be read "1 inch+/−0.5 inch."

Aspects of the present invention are described herein with reference to flowchart illustrations and/or block diagrams of methods, apparatus (systems), and computer program products according to embodiments of the invention. Those of skill in the art will understand that each block of the flowchart illustrations and/or block diagrams, and combinations of blocks in the flowchart illustrations and/or block diagrams, may be implemented by computer readable program instructions. Additionally, those of skill in the art will recognize that the system blocks and method flowcharts, though depicted in a certain order, may be organized in a different order and/or configuration without departing from the substance of the claimed invention.

Figure 1:
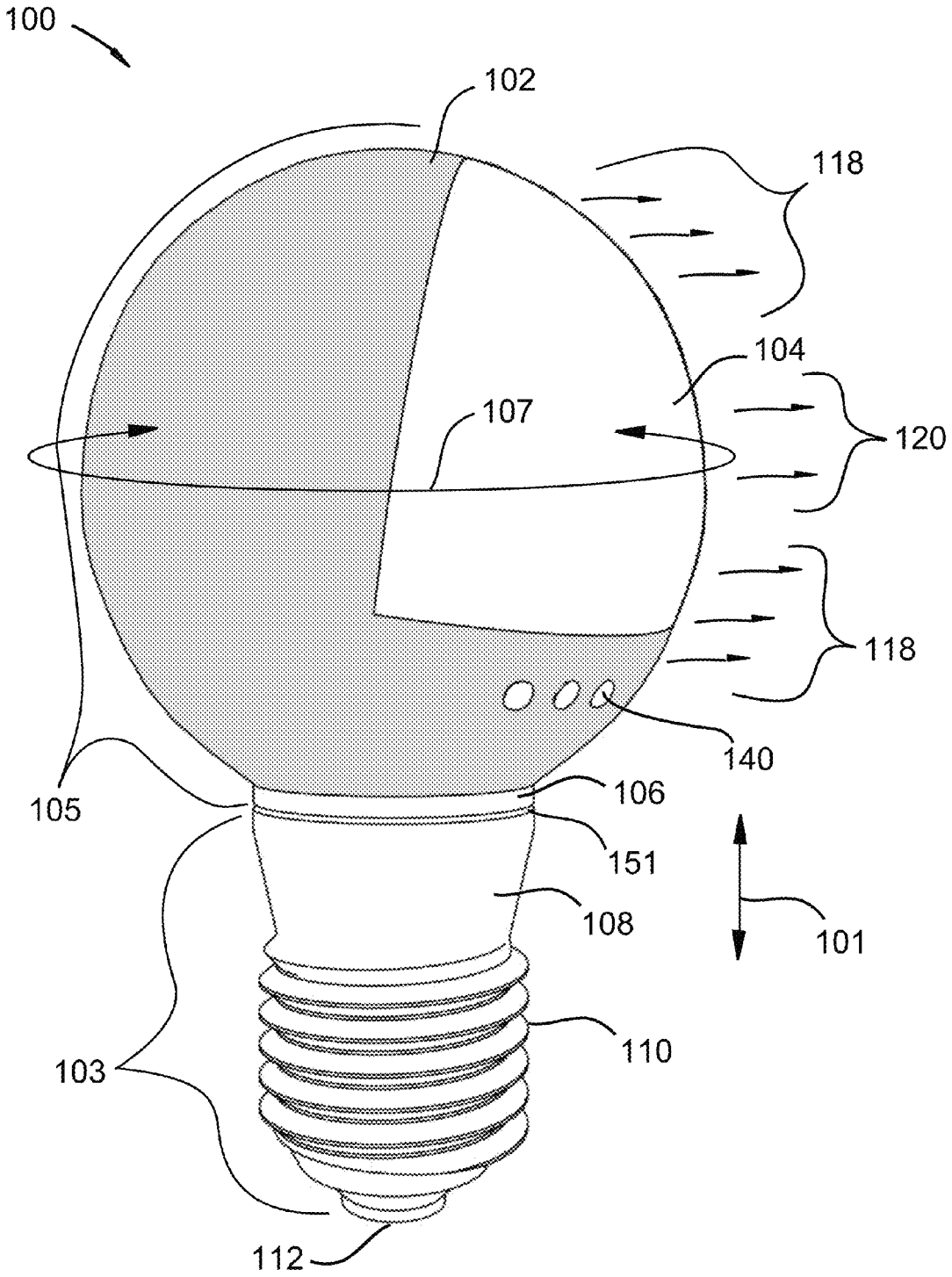
FIG. 1 depicts a light bulb in accordance with an embodiment of the invention.

FIG. 1 depicts a light bulb in accordance with an embodiment of the invention. Light bulb 100 includes light transmitting bulb portion 105 and base portion 103. Light transmitting bulb portion 105 includes aperture 104 (aperture meaning a space through which light passes). Base portion 103 includes a motor with a hollow shaft (shown in FIGS. 3-6). Light transmitting portion 105 is rotated independently of base portion 103 by the motor to direct light produced by light bulb 100 in a direction defined by a rotational position of aperture 104 of light transmitting bulb portion 105.

Aperture 104 may be made of any of a variety of materials, including glass, fused silica, tempered glass, aluminum oxynitride, polycarbonate, polyethylene terephthalate (PET), polyvinyl butyral (PVB), etc. Kaolin may also be deposited on an inner surface of aperture 104. Light transmitting bulb portion 105 may include vents to allow for circulation of air inside and outside of light transmitting bulb portion 105. Aperture 104 may be any of a variety of shapes, including spherical, ovoidal, elliptically paraboloidal, polyhedral, etc. Light transmitting bulb portion 105 may include masked portion 102.

Light transmitting bulb portion 105 may rotate synchronously with base portion 103 in a clockwise or counter clockwise direction when light transmitting bulb portion 105 is pushed in toward base portion 103. Light transmitting bulb portion 105 can move in direction 101 relative to base portion 103. For example, light transmitting bulb portion 105 may include first proximate surface 106 and second proximate surface 108. First surface 106 and second surface 108 may have a substantially circular boundary and first surface 106 may be concentric with second surface 108. A certain magnitude of force may be required to act upon light transmitting bulb portion 105, along a concentric axis 101, (moving first surface 106 relatively close to second surface 108) before light transmitting bulb portion 105 and base portion 103 may rotate synchronously together. When no force is acting upon light transmitting bulb portion 105, as described above, gap 151 may separate first surface 106 and second surface 108. In some embodiments, for example, base portion 103 may include cap 110, wherein cap 110 may be an Edison screw, which may require 0.5 lbf of force or greater to be applied to light transmitting bulb portion 105 normal to a centric axis of cap 110 while 1 lbf ft of torque or greater is simultaneously applied in a clockwise direction about the centric axis to install light bulb 110 within a corresponding light bulb socket. In some further embodiments, if less than 0.5 lbf of force is applied to light transmitting bulb portion 105, first surface 106 may move independently of second surface 108 such that base portion 103 may move independently of light transmitting portion 105. If torque is applied to light transmitting bulb portion 105 in a counterclockwise direction, while a force is applied to light transmitting bulb portion 105 along an axis of rotation, first surface 106 may couple with second surface 108 such that base portion 103 may be removed from a light bulb socket.

Light rays 118 are a result of an inner reflection of masked portion 102. Masked portion 102 provides a reflective inner surface and a masked outer surface. Light transmitting bulb portion 105 transmits light waves 118 and 120 through a light transparent aperture 104. Light rays 120 are rays not reflected from an inner reflective surface but directly transmitted from a light source through aperture 104. Light bulb 100 may be designed with all reflected light rays 118 by only having light sources that face the inner reflective surface of the bulb turned on. This may be desirable where light diffusion requirements specify only reflective light rays or where illumination distance is a specified design parameter of the light bulb. A processor within light 100 may selectively control one or more light sources within light bulb 100 to change or modify light diffusion, spectrum (color), and/or intensity transmitted through aperture 104. Additionally, light bulb 100 may be programmed with all non-reflected light 120 or a combination reflected light 118 and non-reflected light 120 as dictated by design parameters of the light bulb and specified light illumination requirements of lighting applications of light bulb 100. Bulb portion 105 may be rotated in a clock-wise or a counter clock-wise direction allowing aperture 104 and light rays 118 and 120 to be directed in any rotational direction within a 360-degree radius around light bulb 100.

In some additional embodiments, cap 110 of base portion 103 may be a bayonet cap. Cap 110 may be used to install light bulb 100 in a light bulb socket. Cap 110 may also connect to electrical ground while electrical contact 112 may connect to a live power source without a need for a wall switch.

Light transmitting bulb portion 105 may include one or more sensors 140. Sensors 140 may be any of a variety of sensors, including microphones, light intensity sensors, motion detecting sensors, ultrasonic sensors, IR sensors, infrared sensors, camera sensors, CCDs, photo diodes, etc. For example, in some embodiments, sensors 140 may be used to detect motion in an access restricted area. Sensor 140 may subsequently report motion information to a controller which may alert one or more users via peripheral devices. Motion information may also be used to maintain a rotational position of light bulb 100. Audio and/or video information collected via microphones and cameras may also be used to maintain a rotational position of light bulb 100.

Figure 2:
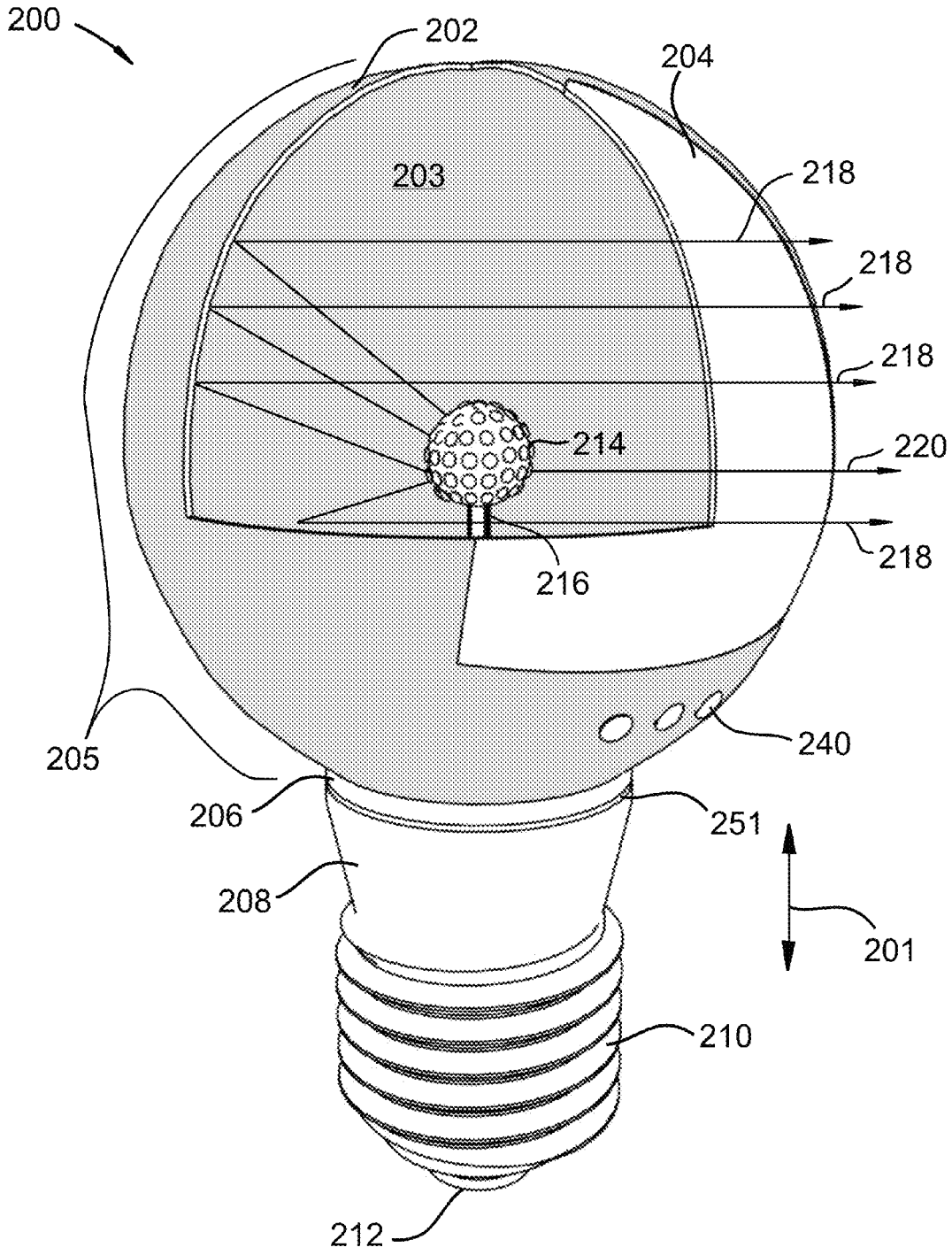
FIG. 2 depicts a light bulb with an exposed light source.

FIG. 2 depicts a light bulb with an exposed light source. Light bulb 200 may include light transmitting bulb portion 205. Light transmitting bulb portion 205 may include aperture 204 and masked portion 202. Masked portion 202 may include light reflecting portion 203. Light reflecting portion 203 may be on an inner surface of light transmitting bulb portion 205. Light reflecting portion 203 may reflect light from one or more light sources 214 such that light emitted from light sources 214 may be directed toward and out of aperture 204. Light reflecting portion 203 may be substantially parabolic in shape, such that multiple rays of reflected light 218 reflected by light reflecting portion 203 may be substantially parallel to each other and in a general direction toward aperture 204. Aperture 204 may subsequently transmit reflected light 218 and non-reflected light 220 to an environment outside of light bulb 200. In some embodiments, the substantially parabolic shape forms a parabolic reflector which includes more than 40% of an inner surface of light transmitting bulb portion 205. In some embodiments, light transmitting bulb portion 205 may include masked portion 202 including to an outside surface of light transmitting bulb portion 205 which may be adjacent and concentric with light reflecting portion 203. In addition, aperture 204 may transmit non-reflected light 220, reflected light 118, or a combination thereof which may be emitted from light sources 214.

Light sources 214 may be light emitting diode (LED) light sources which transmit light through aperture 204 in light transmitting bulb portion 205. LED light sources 214 may be RGB LEDs. LED light sources 214 may be dedicated color LEDs. Hollow tube 216 provides a path for light source wiring to reach a controller within a base portion of the light bulb. Tube 216 provides a support for light sources 214 and provides a non-movable connection to the base portion of the light. The light transmitting bulb portion 205 rotates around tube 216 and light sources 214.

Light transmitting bulb portion 205 may additionally include first proximate surface 206 which may face second proximate surface 208. Aperture 204 may change its angular position with respect to a light bulb socket as first proximate surface 206 is rotated with respect to second proximate surface 208 while gap 251 is sufficiently high. Cap 210 may be used to install light bulb 200 in a light bulb socket. Cap 210 may also connect to electrical ground while electrical contact 212 may connect to a live power source without a need for a wall switch.

Figure 3:
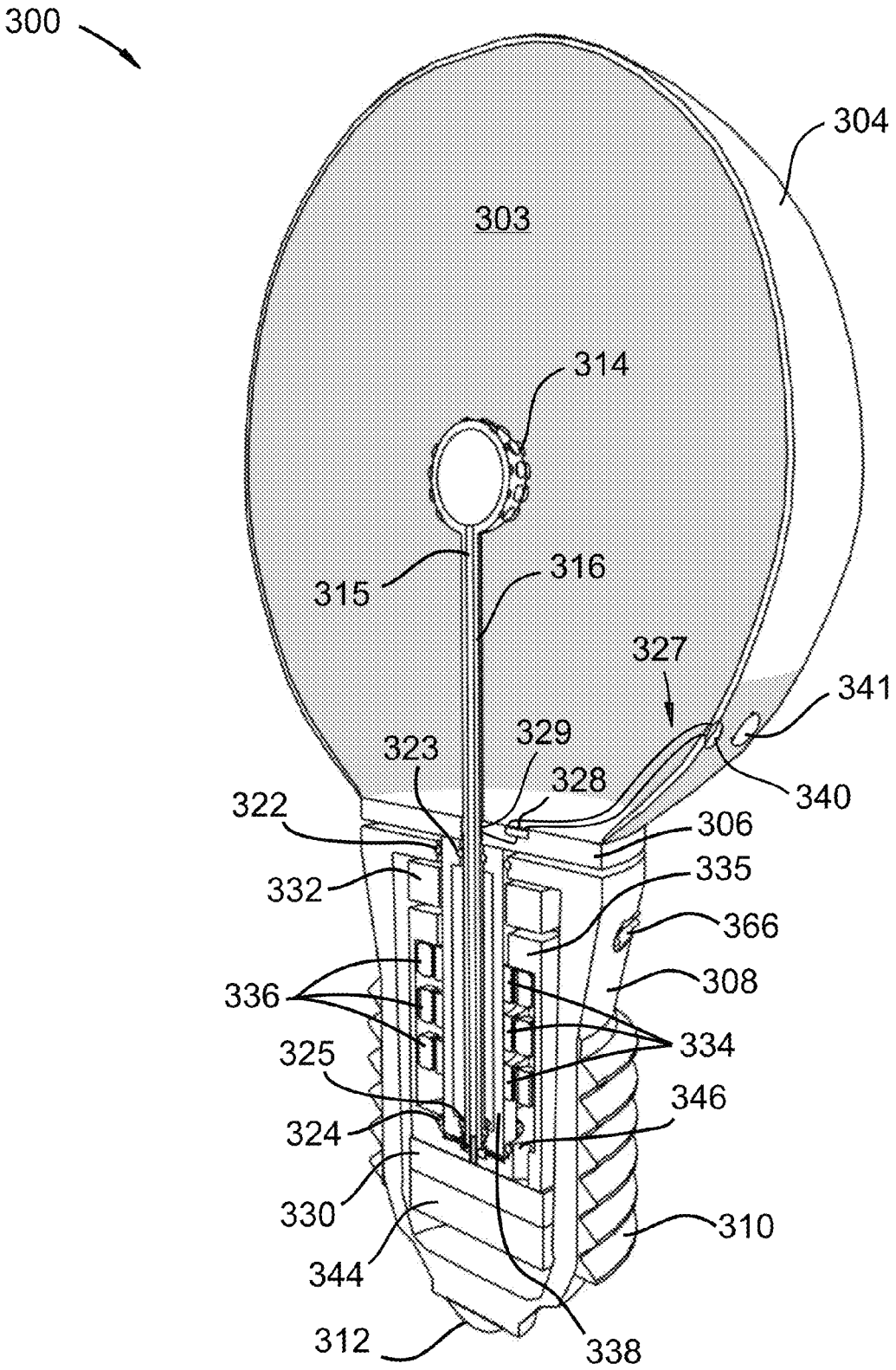
FIG. 3 depicts a perspective cross-section of a light bulb.

FIG. 3 depicts a perspective cross-section of a light bulb. Light bulb base portion 300 of a light bulb may include hollow shaft 316 and one or more light sources 314. One or more light sources 314 may be induction light sources, LED light sources, or ionization light sources. Light sources 314 may be any of a variety of light sources, including incandescent light bulbs, fluorescent light bulbs, arc lamps, vapor lamps, etc.

In some embodiments, one or more light sources 314 may be LED light sources. Light transmitted from one or more LED light sources may be transmitted through an aperture of a light transmitting bulb portion (described above with reference to FIG. 1) of the light bulb when the light bulb is "on". Light bulb 300 may further include controller 330 and a power supply operably connected to one or more light sources 314. The power supply may be connected to light sources 314 via controller 330, power wire 312, and power wire 310, wherein power connection 312 and ground connection 310 may be connected to a live electrical wire and a grounded electrical wire via an electrical light socket. Controller 330 may include a processor, a motor controller, memory, and one or more transceivers 332. Transceivers 332 may include Bluetooth, SureFi, WiFi, and other known home automation wireless systems. Transceivers 332 may enable light bulb 300 to connect with remote databases, local user devices, or Internet enabled devices. Memory 334 may include programming necessary to communicate wirelessly with remote devices and to control light sources 314 of light 300 based on automated programming and/or remote user device control. Controller 330 may include circuitry to regulate power output to light sources 314. Shaft 316 may include one or more light source wires for each of light sources 314 such that wiring of light sources 314 travel through hollow shaft 316 through the motor and down into controller 330.

Figure 4:
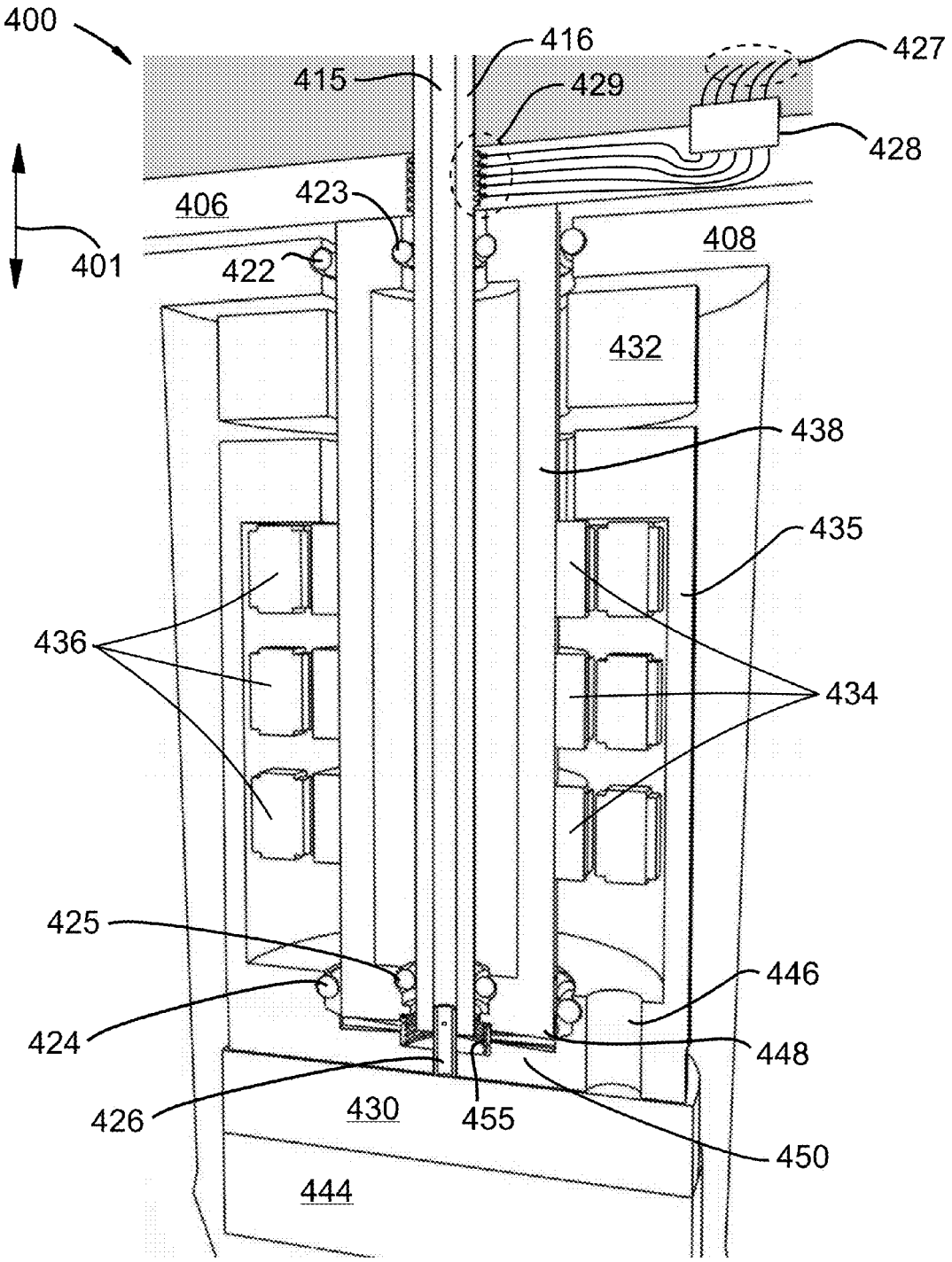
FIG. 4 depicts part of a perspective cross-section of a base of a light bulb.

Light bulb 300 may include spring 455 (shown in FIG. 4). Spring 455 may bias first proximate surface 306 away from second proximate surface 308 with a certain force. While first proximate surface 306 and second proximate surface 308 are pushed away from each other, they may also rotate with respect to each other by motor force. Motor coils 336 create a magnetic force allowing hollow motor shaft 338 to rotate in a clockwise or counter clockwise direction depending on a direction of current flow through coils 336. Motor magnets 334 may be permanent type motor magnets which are fixed to hollow motor shaft 338. Magnets 334 oppose and/or attract a magnetic field created by coils 336 enabling hollow motor shaft 338 to rotate. Controller 330 may include a motor controller or motor driver for driving coils 336 of a stepper motor or servo motor. Hollow motor shaft 338 may be firmly connected to surface 306 such that rotation of hollow motor shaft 338 rotates surface 306 and aperture 304 and reflective surface 303. Hollow light shaft 316 travels completely through hollow motor shaft 338. Hollow light shaft 316 may be vertically movable but rotationally fixed as will be described in relation to FIGS. 4-6 and 11. Hollow light shaft 316 is separated from hollow motor shaft 338 by an upper inner bearing 323 and a lower inner bearing 326. Hollow motor shaft 338 is separated from motor housing 335 by an upper outer bearing 322 and a lower outer bearing 324. Bearings 322-325 may be any type of bearing including roller bearings, ball bearings, bushings, nylon inserts, Teflon inserts, etc. Light shaft 316 includes a hollow space 315 for wiring to travel to controller 330. Brush contacts 329 interface wiring 327 from sensors 340 and 341 into hollow space 315 using composite brushes, monofilament brushes, or multi-fiber brushes. Wiring 327 may carry digital or analog signals from sensors 340 and 341 to controller 330 via connector 328 and brush contacts 329. Auxiliary connection 366 may be a micro USB port which may allow programming and charging of light 300. Wireless transceiver 332 may enable wireless device to connect with light bulb 300 for programing and commanding light bulb 300. Wireless transceiver 332 may obtain power from battery 344.

Battery 344 may be a rechargeable battery. Battery 344 may supply either primary or secondary power to light sources 314 and wireless transceiver 332 by way of controller 330. Battery 344 may be recharged based on programming in memory of controller 330. Programming may direct controller 330 to charge battery 344 based on a state-of-charge of battery 344. Controller 330 may be coupled to battery 344 to power it when power source when other power sources 312 and 310 are not available. In some embodiments, controller 330 may charge battery 344 with power obtained via power connectors 312 and 310. The controller may use power from connectors 312 and 310 and/or battery 344 to turn "on" lights 314 by way of one or more light wires running through hollow space 315.

FIG. 4 depicts part of a perspective view of a base portion of a light bulb. Light base portion 400 may include spring 455. Spring 455 may bias first proximate surface 406 away from second proximate surface 408 with a certain force. While first proximate surface 406 and second proximate surface 408 are pushed away from each other, they may also rotate with respect to each other by motor force. When surface 406 and 408 are pushed together, gear surfaces 448 and 450 mesh together allowing the light bulb to rotate as one unit enabling the light to be screwed in a light socket or removed from a light socket. Gear surfaces 448 and 450 may also be formed in surfaces 406 and 408 of light 400 with a spring providing a separation force between the surfaces. Motor coils 436 create a magnetic force allowing hollow motor shaft 438 to rotate in a clockwise or counter clockwise direction depending on a direction of current flow through coils 436. Motor magnets 434 may be permanent type motor magnets which are fixed to hollow motor shaft 438. Magnets 434 oppose and/or attract a magnetic field created by coils 436 enabling hollow motor shaft 438 to rotate. Controller 430 may include a motor controller or motor driver for driving coils 436 of a stepper motor or servo motor. Hole 446 may allow wires from each motor coil 436 to reach controller 430. Hollow motor shaft 438 may be firmly connected to surface 406 such that rotation of hollow motor shaft 438 rotates surface 406 and an aperture of the light bulb. Hollow light shaft 416 travels completely through hollow motor shaft 438. Hollow light shaft 416 is vertically movable but rotationally fixed. Hollow sleeve 426 provides an entrance into controller 430 for light source wires and for light sensor wires 427. When surface 406 and surface 408 move vertically (direction 401) in relation to each other, hollow light shaft 416 moves in direction 401 with surface 406 but does not rotate with surface 406 due to pin 1137 and slot 1139 (of FIG. 11), thus allowing brush connectors 429 to stay connected with sensor wires 427. Hollow light shaft 416 is separated from hollow motor shaft 438 by an upper inner bearing 423 and a lower inner bearing 425. Hollow motor shaft 438 is separated from motor housing 435 by an upper outer bearing 422 and a lower outer bearing 424. Bearings 422-425 may be any type of bearing including roller bearings, ball bearings, bushings, nylon inserts, Teflon inserts, etc. Light shaft 416 includes a hollow space 415 for wiring to travel to controller 430. Brush contacts 429 sensor wiring 427 from light sensors into hollow space 415 using composite brushes, monofilament brushes, or multi-fiber brushes. Wiring 427 may carry digital or analog signals from sensors connected to the rotational light portion to controller 430 via connector 428 and brush contacts 429. Wireless transceiver 432 may enable wireless device to connect with light bulb 400 for programing and commanding light bulb 400. Wireless transceiver 432 may obtain power from battery 444.

Battery 444 may be a rechargeable battery. Battery 444 may supply either primary or secondary power to light sources and wireless transceiver 432 by way of controller 430. Battery 444 may be recharged based on programming in memory of controller 430. Programming may direct controller 430 to charge battery 444 based on a state-of-charge of battery 444. Controller 430 may be coupled to battery 444 to power it when power source when other power sources are not available. In some embodiments, controller 430 may charge battery 444 with power obtained via light power connectors.

Figure 5:
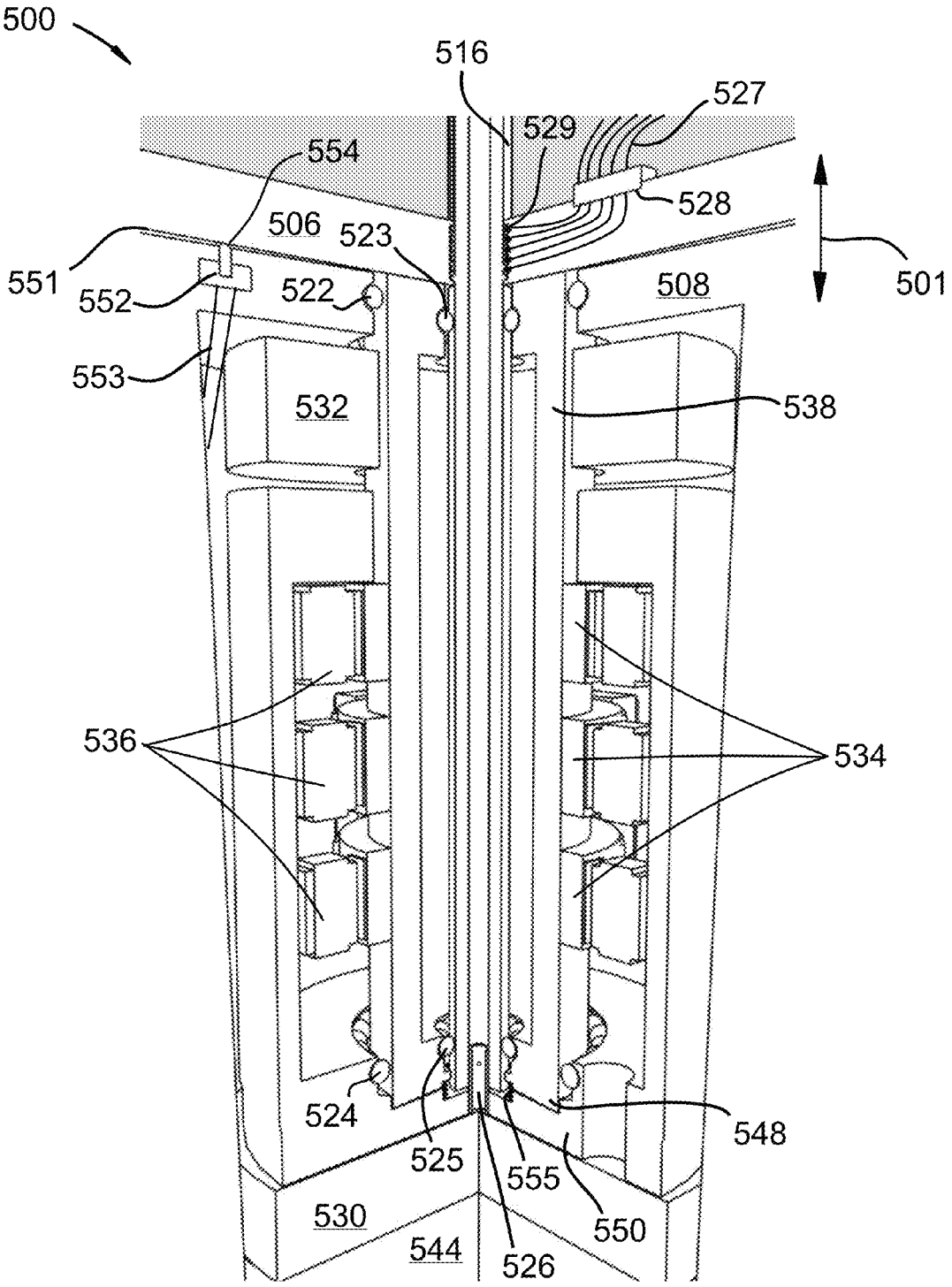
FIG. 5 depicts part of a perspective cross-section of a base of a light bulb.

FIG. 5 depicts a cut out section view of a light bulb. Light base portion 500 may include spring 555. Spring 555 may bias first proximate surface 506 away from second proximate surface 508 with a certain force. Gap 551 shows spring 555 in a compressed positon. This compressed position is a result of surface 508 and 506 being pushed together with force enough to compress spring 555 and mesh gear surfaces 548 and 550. Switch 552 includes an actuator 554 and wires 553. When surfaces 506 and 508 are pushed together, actuator 554 depresses switch 552 indicating to controller 530 by wires 553 that the gears 548 and 550 are meshed together and instructs controller 530 to keep motor components 536 from rotating hollow motor shaft 538. Switch 552 is a safety interlock which protects the light bulb from destroying itself when the gears are engaged. Switch 552 may be normally open or normally closed. Switch may physically disconnect power to one or more components providing a physical safety interlock or may provide a software input interlock to controller 530. With gear surfaces 548 and 550 meshed together, it is possible to rotate a top portion of the light and have the bottom portion 500 rotate in a synchronous manner. This compressed state allows the light bulb portion 500 to be screwed into or out of a light socket. While first proximate surface 506 and second proximate surface 508 are pushed away from each other, they may also rotate with respect to each other by motor force. When surface 506 and 508 are pushed together, gear surfaces 548 and 550 mesh together allowing the light bulb to rotate as one unit enabling the light to be screwed in a light socket or removed from a light socket without turning the motor shaft 538 independent of the base of the light. Gear surfaces 548 and 550 may also be formed in surfaces 506 and 508 of light 500 with a spring providing a separation force between the surfaces. Motor coils 536 create a magnetic force allowing hollow motor shaft 538 to rotate in a clockwise or counter clockwise direction depending on a direction of current flow through coils 536. Motor magnets 534 may be permanent type motor magnets which are fixed to hollow motor shaft 538. Magnets 534 oppose and/or attract a magnetic field created by coils 536 enabling hollow motor shaft 538 to rotate. Controller 530 may include a motor controller or motor driver for driving coils 536 of a stepper motor or servo motor. Hollow motor shaft 538 may be firmly connected to surface 506 such that rotation of hollow motor shaft 538 rotates surface 506 and the light aperture. Hollow light shaft 516 travels completely through hollow motor shaft 538. Hollow light shaft 516 is vertically movable but rotationally fixed. Hollow sleeve 526 provides an entrance into controller 530 for light source wires and for light sensor wires 527. When surface 506 and surface 508 move vertically (direction 501) in relation to each other, hollow light shaft 516 moves in direction 501 with surface 506 but does not rotate with surface 506 due to pin 1137 and slot 1139 (of FIG. 11), thus allowing brush connectors 529 to stay connected with sensor wires 527. Hollow light shaft 516 is separated from hollow motor shaft 538 by an upper inner bearing 523 and a lower inner bearing 525. Hollow motor shaft 538 is separated from motor housing 535 by an upper outer bearing 522 and a lower outer bearing 524. Bearings 522-525 may be any type of bearing including roller bearings, ball bearings, bushings, nylon inserts, Teflon inserts, etc. Light shaft 516 includes a hollow space for wiring to travel to controller 530. Brush contacts 529 sensor wiring 527 from light sensors into hollow space 515 using composite brushes, monofilament brushes, or multi-fiber brushes. Wiring 527 may carry digital or analog signals from sensors connected to the rotational light portion to controller 530 via connector 528 and brush contacts 529. Wireless transceiver 532 may enable wireless device to connect with light bulb 500 for programing and commanding light bulb 500. Wireless transceiver 532 may obtain power from battery 544.

Battery 544 may be a rechargeable battery. Battery 544 may supply either primary or secondary power to light sources and wireless transceiver 532 by way of controller 530. Battery 544 may be recharged based on programming in memory of controller 530. Programming may direct controller 530 to charge battery 544 based on a state-of-charge of battery 544. Controller 530 may be coupled to battery 544 to power it when power source when other power sources are not available. In some embodiments, controller 530 may charge battery 544 with power obtained via light power connectors.

Light bulb 500 may also include controller 530 which may enable wireless communications, data processing, and Internet connectivity to light bulb 500. Controller may be electrically connected to one or more light sources within light bulb 500. Light bulb 500 may additionally include power source 544 which may store and supply power to controller 530. Power source 544 may be a capacitor, a battery, an electrical line, etc.

Figure 6:
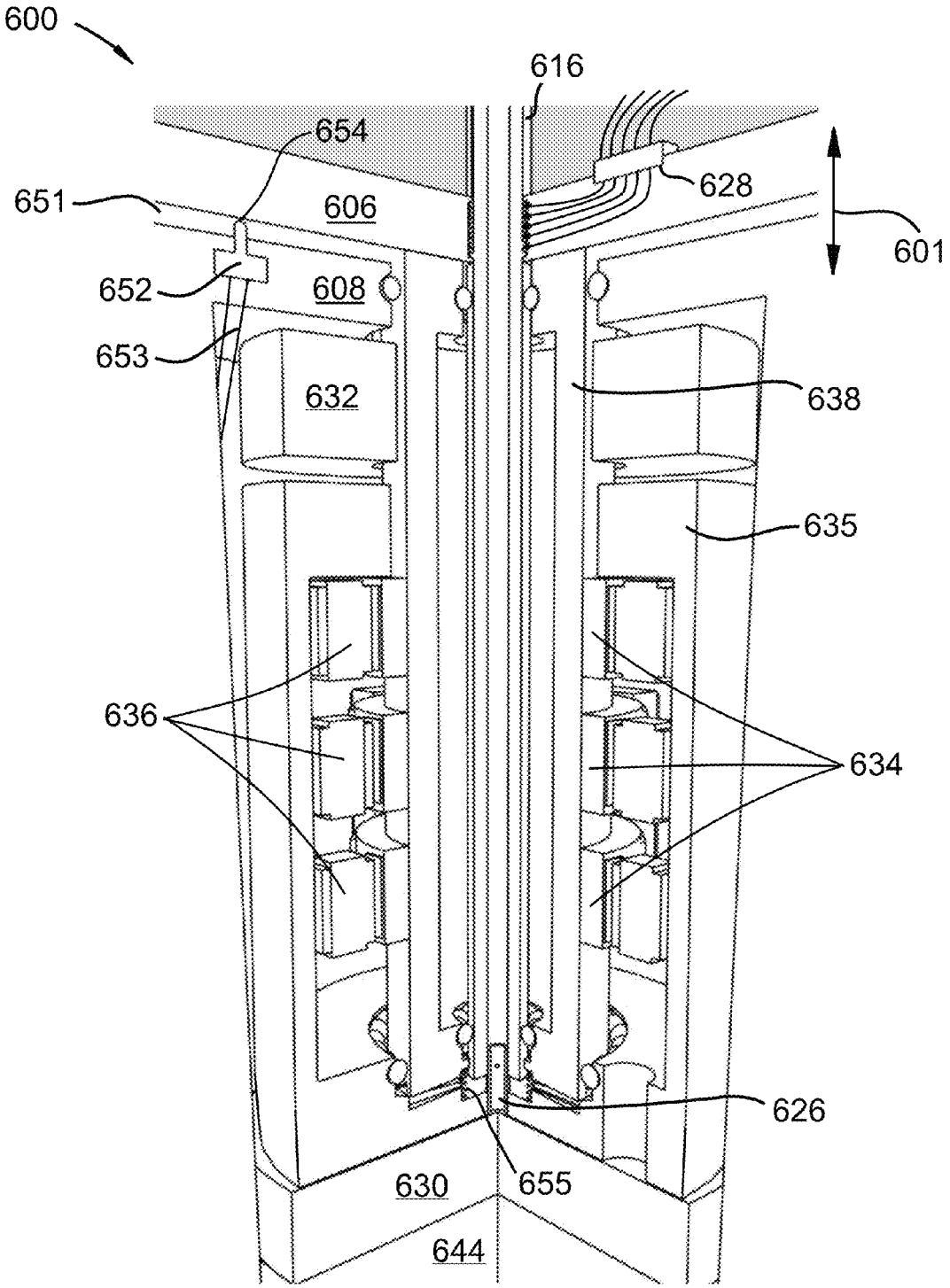
FIG. 6 depicts part of a perspective cross-section of a base of a light bulb similar to FIG. 5 with parts of a light bulb moved to different positions.

FIG. 6 depicts an embodiment similar to FIG. 5 with parts of a light bulb moved to different positions. Light base portion 600 may include spring 655. Spring 655 may bias first proximate surface 606 away from second proximate surface 608 with a certain force. Gap 651 shows spring 655 in an uncompressed positon. This uncompressed position is a result of surface 608 and 606 not being pushed together with force enough to compress spring 655 and mesh gear surfaces together. Switch 652 includes an actuator 654 and wires 653. When surfaces 606 and 608 are not pushed together (also shown in FIG. 11), actuator 654 does not depresses switch 652 indicating to controller 630 by wires 653 that gears are not meshed together and instructs controller 630 to allow motor components 636 to rotate hollow motor shaft 538 upon command. Switch 652 is a safety interlock which protects the light bulb from destroying itself when gears connected to the base portion and the rotating aperture are engaged (as shown in FIG. 5). Switch 652 may be normally open or normally closed. Switch may physically disconnect power to one or more components providing a physical safety interlock or may provide a software input interlock to controller 630. With safety switch 652 in a non-depressed position, it is possible to use motor components to rotate a top portion of the light and have the bottom portion stay in a fixed position. This rotatable state allows the light bulb aperture to be rotated in 360-degree about axis 601. Motor coils 636 create a magnetic force allowing hollow motor shaft 638 to rotate in a clockwise or counter clockwise direction depending on a direction of current flow through coils 636. Motor magnets 634 may be permanent type motor magnets which are fixed to hollow motor shaft 638. Magnets 634 oppose and/or attract a magnetic field created by coils 636 enabling hollow motor shaft 638 to rotate. Controller 630 may include a motor controller or motor driver for driving coils 636 of a stepper motor or servo motor. Hollow motor shaft 638 may be firmly connected to surface 606 such that rotation of hollow motor shaft 638 rotates surface 606 and the light aperture. Hollow light shaft 616 travels completely through hollow motor shaft 638. Hollow light shaft 616 is vertically movable but rotationally fixed. Hollow sleeve 626 provides an entrance into controller 530 for light source wires and for sensor wires of the light. When surface 606 and surface 608 move vertically (direction 601) in relation to each other, hollow light shaft 616 moves in direction 601 with surface 606 but does not rotate with surface 606 due to pin 1137 and slot 1139 (of FIG. 11), thus allowing brush connectors to stay connected with sensor wires. Hollow light shaft 616 is separated from hollow motor shaft 638 by an upper inner bearing and a lower inner bearing. Hollow motor shaft 638 is separated from motor housing 635 by an upper outer bearing and a lower outer bearing. Motor shaft bearings may be any type of bearing including roller bearings, ball bearings, bushings, nylon inserts, Teflon inserts, etc. Light shaft 616 includes a hollow space for wiring to travel to controller 630. Wireless transceiver 632 may enable wireless device to connect with light bulb 600 for programing and commanding light bulb 600. Wireless transceiver 632 may obtain power from battery 644.

Battery 644 may be a rechargeable battery. Battery 644 may supply either primary or secondary power to light sources and wireless transceiver 632 by way of controller 630. Battery 644 may be recharged based on programming in memory of controller 630. Programming may direct controller 630 to charge battery 644 based on a state-of-charge of battery 644. Controller 630 may be coupled to battery 644 to power it when power source when other power sources are not available. In some embodiments, controller 630 may charge battery 644 with power obtained via light power connectors.

Light bulb 600 may also include controller 630 which may enable wireless communications, data processing, and Internet connectivity to light bulb 600. Controller may be electrically connected to one or more light sources within light bulb 600. Light bulb 600 may additionally include power source 644 which may store and supply power to controller 630. Power source 644 may be a capacitor, a battery, an electrical line, etc.

Figure 7:
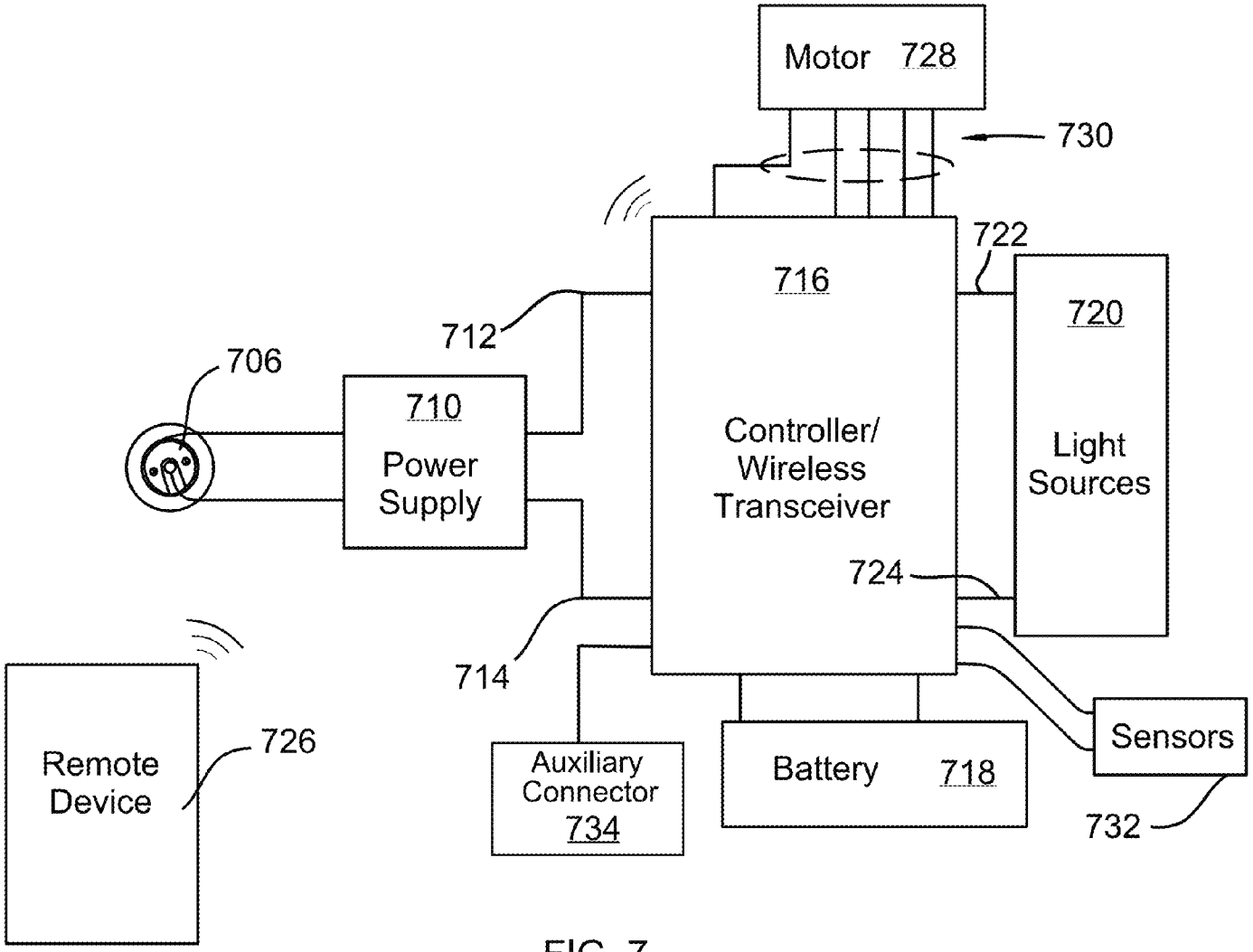
FIG. 7 depicts a schematic diagram in accordance with an embodiment of the invention.

FIG. 7 depicts a schematic diagram in accordance with an embodiment of the invention, wherein components 710-734 are contained in a light bulb 300 as shown in FIG. 3. In some embodiments, light sources 720 may be electrically coupled to controller 716 by two or more wires 722 and 724, Wires 722 and 724 may be duplicated for each light source of light sources 720. That is each light source of light source 720 may include one or more individual wires connecting to controller 716 enabling individual control of each light source by controller 716. Controller 716 may include memory, processors, one or more wireless transceivers, A-D and D-A converters, registers, digital and analog inputs, digital and analog outputs, motor controller outputs, motor controller inputs, etc. Motor wires 730 may be shielded wires. Power supply 710 may contain a power transformer, regular, rectifiers, capacitors, etc. needed for suppling power to controller 716. Auxiliary connector 734 may be a micro USB input/output connector allowing a direct wired connection for powering and programming controller 716, light sources 720, and battery 718. Sensors 732 may be any of a variety of sensors, including microphones, light intensity sensors, motion detecting sensors, ultrasonic sensors, IR sensors, infrared sensors, camera sensors, CCDs, photo diodes, etc. Battery 718 may be a rechargeable battery which supplies either primary or secondary power to light sources 720 and wireless transceiver 716 by way of controller 716. Battery 718 may be recharged based on programming in memory of controller 716. Programming may direct controller to charge battery 716 based on a state-of-charge of battery 718. Wireless transceiver 716 may be coupled to battery 718 to power it when power source when other power sources 706 are not available. In some embodiments, wireless transceiver may charge battery 718 with power obtained via power supply 710. Wireless transceiver 716 may include a controller. The controller may use power from power source 710 and battery 718 to turn "on" lights 720 by way of one or more light wires 722.

Remote device 726 may include user devices such as smart phones, iPads, iPods, laptops, tablets, and computers; other remote devices may include Internet routers, Internet bridges, Internet switches, remote database servers, remote websites, and remote networks.

Motor 728 may include a stepper motor or servo motor which is able to rotate in small steps or increments at slow speeds. Other motors such as DC motors, slit-phase motors, and three-phase motors may also be used.

Figure 8:
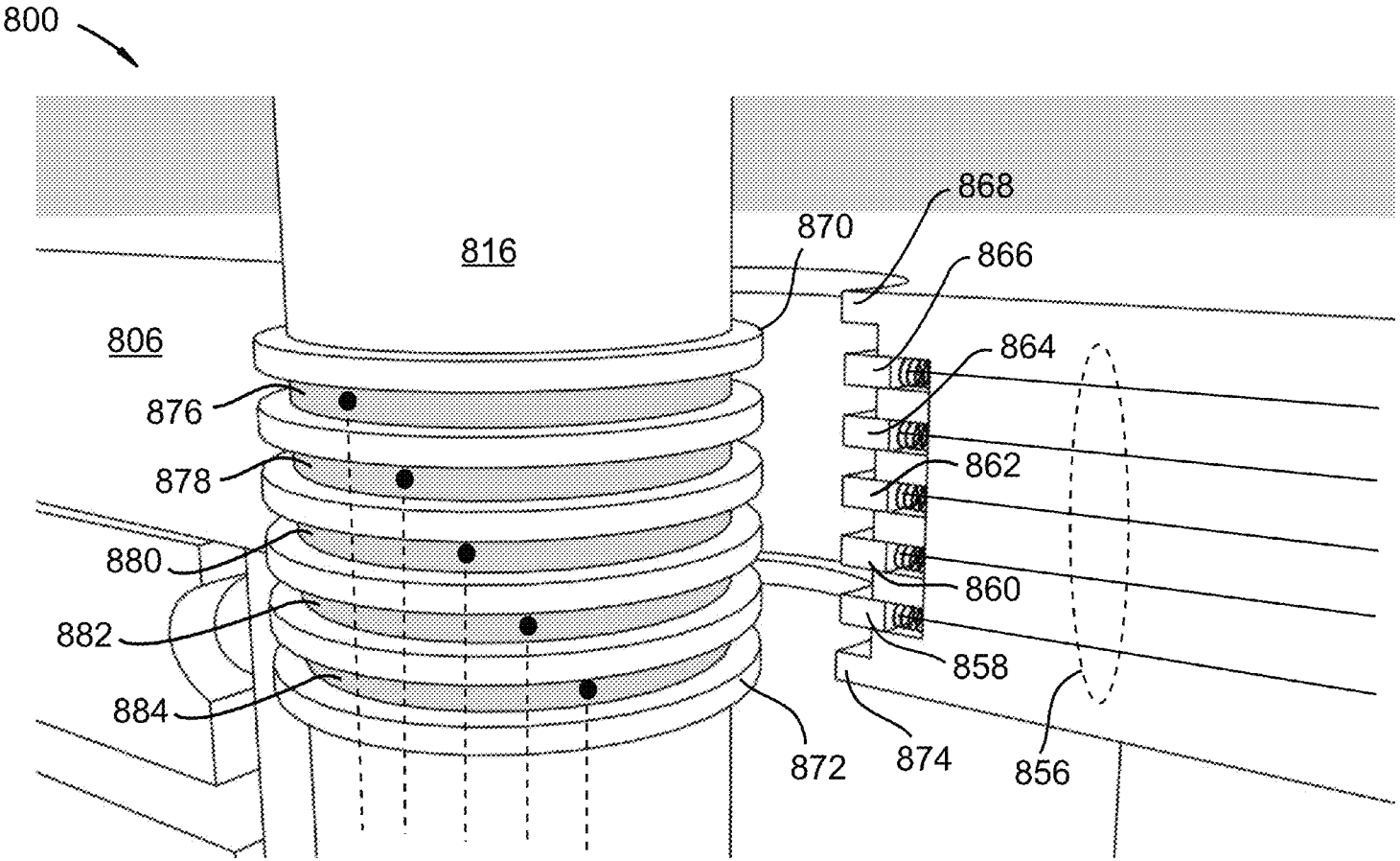
FIG. 8 depicts rotational wiring connections of a light bulb in accordance with an embodiment of the invention.

FIG. 8 depicts a magnified perspective view of brush connections. Light bulb 800 may include brushes 858-866. Each brush may have a force pushing against a rotational contact surface 876-884. The force may be a spring, a compliant mechanism, or a natural material spring force. Each brush has at least one wire 856 connected to the brush and transmits analog, digital or power signals from sensors in the rotational aperture portion of the light to a controller in the base portion by way of hollow light tube 816. Hollow light tube 816 includes stationary contact rings 876-884 which have internal light tube wires connected to each ring 876-884 on an inner surface of the light tube 816. Wires 856 may be shielded. One or more of the brush contacts may be used for a shielding connection. Brush contacts may comprise composite brushes, monofilament brushes, or multi-fiber brushes. Wiring 856 may carry digital or analog signals from sensors to a controller within a base of the light. Wires 856 may include two power wires, two data wires, and one common shield wire. Wires 856 may include any number of wires of two or more. Five wires are shown for convenience in using USB type sensor data connections. Support surfaces 868, 874, 872, and 870 provide support for interlocking light shaft 816 with rotational surface 806. As surface 806 rotates, brushes 866-585 provide power and/or data from/to sensors in a rotational portion of the light bulb to/from a controller in a non-rotating portion of a base of the light bulb.

Figure 9:
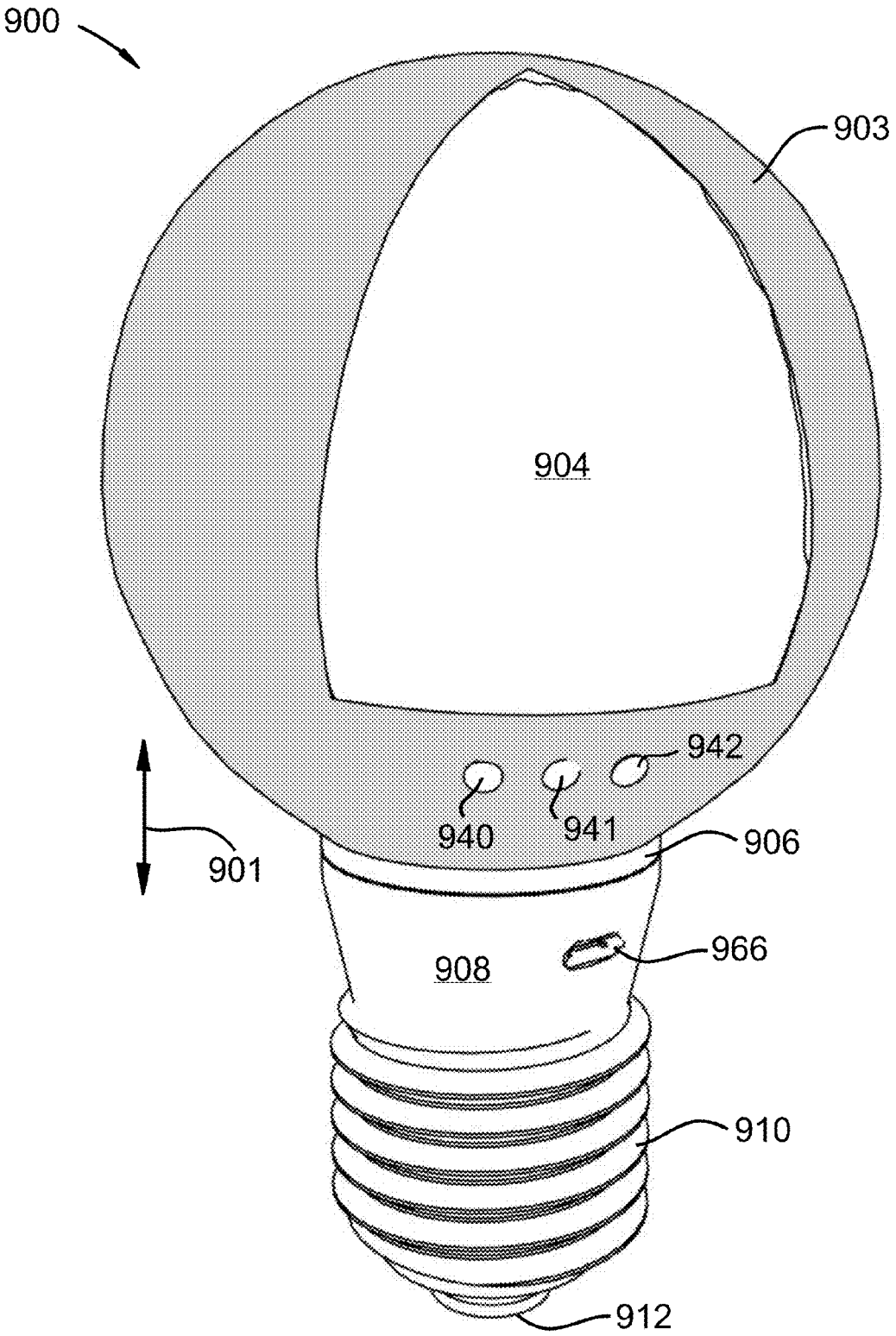
FIG. 9 depicts a light bulb in accordance with an embodiment of the invention.

FIG. 9 depicts a side view of a light bulb assembly. Light bulb 900 may include a light transmitting aperture portion 904 and a base portion 908. Sensors 940, 941, and 942 may be any of a variety of sensors, including microphones, light intensity sensors, motion detecting sensors, ultrasonic sensors, IR sensors, infrared sensors, camera sensors, CCDs, photo diodes, etc. For example, in some embodiments, sensors 940, 941, and 942 may be used to detect motion in an access restricted area. Sensor 940, 941, and 942 may subsequently report motion information to a controller which may alert one or more users via peripheral devices. Motion information may also be used to maintain a rotational position of light bulb 900. Audio and/or video information collected via microphones and cameras may also be used to maintain a rotational position of light bulb 900. Auxiliary port 966 may be a micro USB port and may enable charging and programing light 900. Aperture 904 may be defined by a size of a masked portion 903. Aperture 904 may be sized for light directionality, distance, and intensity. Light 900 is movable rotationally in 360-degrees around axis 901. Light mask portion 903 is movable in an axial direction 901 in relation to base portion 908. When light mask portion 903 is depressed, gears engage enabling portion 903 and portion 908 to be synchronously rotated to install or remove light 900. Depressing portion 903 along axis 901 toward portion 908 also disengages a motor within light 900 from operation. Power supplied by power connectors 912 and 910 may be used to operated light 900 when light 900 is in a light socket. Additional battery power is located within light 900.

Figure 10:
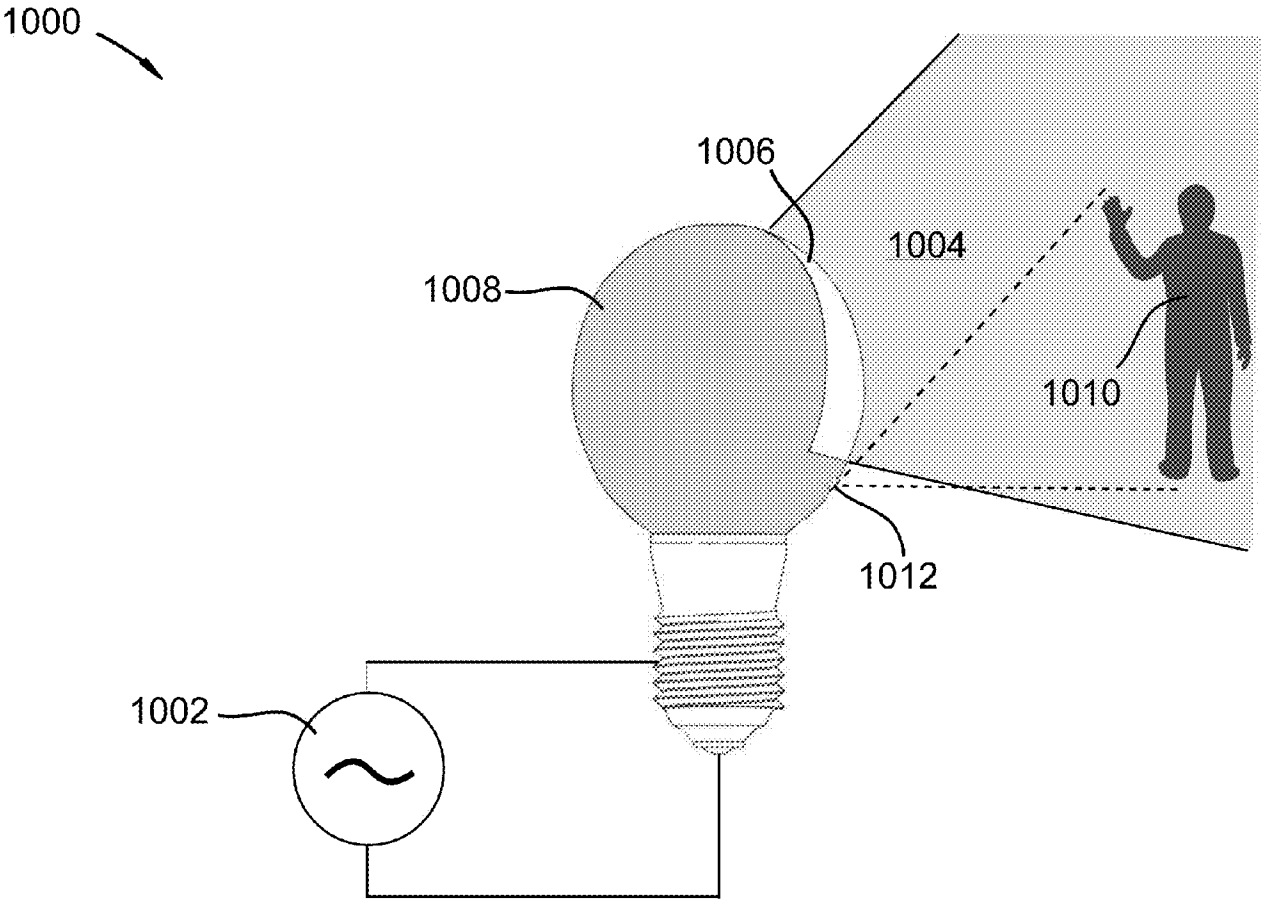
FIG. 10 depicts an electrical power source connected to a light bulb in accordance with an embodiment of the invention.

FIG. 10 depicts an electrical power source connected to a light bulb. Electrical system 1000 may include power source 1002 which is connected to a light bulb. The light bulb may have masked portion 1008 and aperture 1006. Aperture 1006 allows light 1004 to pass through it. Masked portion 1008 may block light 1004 and may also redirect or reflect light 1004 that impinges on an inner surface inside masked portion 1008 such that nearly all light 1004 may be directed out of aperture 1006. In some embodiments, masked portion 1008 is made of a material which reflects heat as well as light on an inner surface while absorbing heat on an outer surface. Light aperture 1006 may be rotated to direct light 1004 in a 360-degree rotation around the light bulb while the light bulb is installed and while the light is on. Sensors 1012 located on a rotational portion of the light may have a field-of-view (dashed lines in FIG. 10) for monitoring movement 1010 within the field-of-view. Light system 1000 may track movement 1010 in a 360-degree rotational view while applying light on the movement. Sensors 1012 may include cameras and microphone which track and record noise and images associated with movement 1010. Notifications may be sent to user devices such as smart phones and computers by text, instant messages, emails etc. indicating and tracking in real-time movement 1010 or other reportable data such as smoke, fire, water, sounds, images, video, etc.

Figure 11:
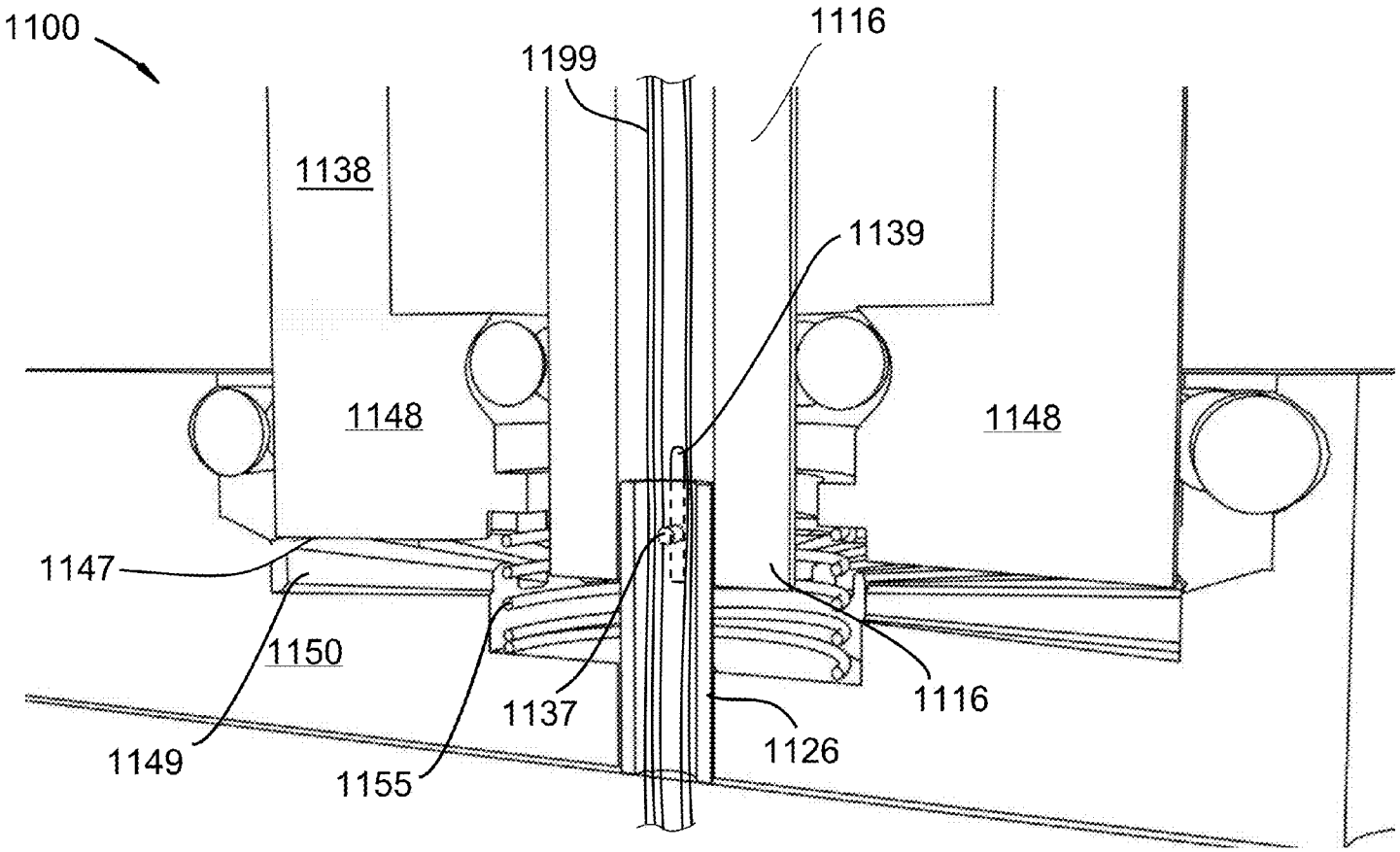
FIG. 11 depicts part of a perspective cross-section of a base of a light bulb.

FIG. 11 depicts a magnified view of light portion 1100 in an uncompressed position. is a result of surface 1148 and 1150 not being pushed together with force enough to compress spring 1155 and mesh gear surfaces 1149 and 1147 together. Surface 1148 is connected to hollow motor shaft 1138 and moves in a downward direction when force is applied to the light bulb in a direction which compresses spring 1155. A light transmitting bulb portion may be connected to surface 1148 and when pushed toward base portion 1150, a first gear 1147 associated with the light transmitting bulb portion engages a second gear 1149 associated with the base portion. Hollow light shaft 1116 runs completely through hollow motor shaft 1138 but does not rotate with hollow motor shaft 1138. Hollow sleeve 1126 provides a conduit into controller 630 (of FIG. 6) for wires 1199. Wires 1199 include light source wires and sensor wires traveling through hollow light shaft 1116. Hollow light shaft 1116 has a vertical slot 1139 which interconnects with pin 1137. Pin 1137 travels through hollow sleeve 1126 allowing hollow light shaft 1116 to slide up and down over a circumference of hollow sleeve 1126 while pin 1137 rides inside of slot 1139. Slot 1139 is symmetrical on both sides of hollow light shaft 1116. Pin 1137 travels from one side of hollow light shaft to the other side and is fixed to hollow sleeve 1126. Pin 1137 keeps hollow light shaft 1116 from rotating with hollow motor shaft 1138 because hollow sleeve 1126 is fixed to base portion 1150.

The invention claimed is:

1. A light bulb comprising:
a light transmitting bulb portion comprising an aperture;
a base portion comprising a motor with a hollow shaft; and
wherein the light transmitting portion is rotated independently of the base portion by the motor to direct light produced by the light bulb in a direction defined by a rotational position of the aperture of the light transmitting bulb portion.

2. The light bulb of claim 1, wherein the base portion comprises an Edison screw.

3. The light bulb of claim 1, wherein the light transmitting bulb portion rotates synchronously with the base portion in a clockwise or counter clockwise direction when the light transmitting bulb portion is pushed in toward the base portion.

4. The light bulb of claim 1, wherein the light transmitting bulb portion comprises one or more sensors.

5. The light bulb of claim 1, wherein the light transmitting bulb portion further comprises a light reflecting portion on an inner surface of the light transmitting bulb portion.

6. The light bulb of claim 5, wherein the light reflecting portion is substantially parabolic in shape.

7. The light bulb of claim 6, wherein the substantially parabolic shape forms a parabolic reflector which comprises more than 40% of an inner surface of the light transmitting bulb portion.

8. The light bulb of claim 1, further comprising one or more light sources, wherein wiring of the one or more light sources travel through the hollow shaft to the motor.

9. The light bulb of claim 8, wherein one or more light sources are LED (light emitting diode) light sources.

10. The light bulb of claim 9, wherein the LED light sources transmit light through the aperture in the light transmitting bulb portion.

11. The light bulb of claim 8, wherein light transmitted from the one or more LED light sources is transmitted through the light transmitting bulb portion of the light bulb when the light bulb is "on".

12. The light bulb of claim 8, wherein the light transmitting bulb portion is pushed in toward the base portion to engage a first gear associated with the light transmitting bulb portion and a second gear associated with the base portion.

13. The light bulb of claim 12, wherein the light transmitting bulb portion is rotatable while the light bulb is turned "on" without rotating the one or more LED light sources.

14. The light bulb of claim 12, further comprising a spring.

15. The light bulb of claim 14, wherein the spring pushes the light transmitting bulb portion away from the base portion.

16. The light bulb of claim 12, wherein the first gear and the second gear interlock to screw the base portion into a light socket.

17. The light bulb of claim 12, wherein the first gear and the second gear interlock to unscrew the base portion out of a light socket.

18. The light bulb of claim 8, wherein the one or more light sources are induction light sources.

19. The light bulb of claim 8, further comprising a controller and a power supply operably connected to the one or more light sources.

20. The light bulb of claim 19, wherein the controller comprises a processor, memory, and one or more transceivers.

* * * * *